US011480415B2

(12) United States Patent
Betscher et al.

(10) Patent No.: US 11,480,415 B2
(45) Date of Patent: Oct. 25, 2022

(54) PYROTECHNIC IGNITION PILL AND METHOD FOR MANUFACTURING A PYROTECHNIC IGNITION PILL

(71) Applicant: Auto-Kabel Management GmbH, Hausen i.W. (DE)

(72) Inventors: Simon Betscher, Grevenbroich (DE); Markus Moszynski, Erkelenz (DE)

(73) Assignee: Auto-Kabel Management GmbH, Hausen i.W (DE)

( * ) Notice: Subject to any disclaimer, the term of this patent is extended or adjusted under 35 U.S.C. 154(b) by 0 days.

(21) Appl. No.: 17/635,525

(22) PCT Filed: Jun. 22, 2020

(86) PCT No.: PCT/EP2020/067312
§ 371 (c)(1),
(2) Date: Feb. 15, 2022

(87) PCT Pub. No.: WO2021/043455
PCT Pub. Date: Mar. 11, 2021

(65) Prior Publication Data

US 2022/0299298 A1 Sep. 22, 2022

(30) Foreign Application Priority Data

Sep. 5, 2019 (DE) ..... 10 2019 123 755.6

(51) Int. Cl.
*F42B 3/103* (2006.01)
*F42B 3/12* (2006.01)
*F42B 3/195* (2006.01)

(52) U.S. Cl.
CPC ..... *F42B 3/103* (2013.01); *F42B 3/125* (2013.01); *F42B 3/195* (2013.01)

(58) Field of Classification Search
CPC ..... F42B 3/103; F42B 3/125; F42B 3/195
(Continued)

(56) References Cited

U.S. PATENT DOCUMENTS 5,596,163 A * 1/1997 Caflisch ..... B60R 21/2644 102/202.7
9,778,001 B2 * 10/2017 Hinkofer ..... F42B 3/12
(Continued)

FOREIGN PATENT DOCUMENTS

DE 28 11 351 A1 9/1979
DE 78 27 865 U1 1/1980
(Continued)

OTHER PUBLICATIONS

International Searching Authority/European Patent Office, International Search Report and Written Opinion of the International Searching Authority, Application No. PCT/EP2020/067312, dated Sep. 25, 2020, *with English translation of the International Search Report*, 17 pages.
(Continued)

*Primary Examiner* — Samir Abdosh
(74) *Attorney, Agent, or Firm* — Sunstein LLP

(57) ABSTRACT

A pyrotechnic ignition pill with a housing, an ignition pill charge housed in the housing, at least two terminal contacts connected to the ignition charge, wherein the terminal contacts are guided out of the housing through a glass bushing, characterized in that the terminal contacts in the region of the ignition charge have a round cross-sectional profile and that the terminal contacts outside the housing have an angular cross-sectional profile.

12 Claims, 7 Drawing Sheets

(58) Field of Classification Search
USPC ..... 102/202.9
See application file for complete search history.

(56) References Cited

U.S. PATENT DOCUMENTS

| | | | | |
|---|---|---|---|---|
| 2004/0079544 | A1* | 4/2004 | Heeke | F42B 3/10 174/50.56 |
| 2013/0305948 | A1* | 11/2013 | Hinkofer | F42B 3/124 102/202.7 |

FOREIGN PATENT DOCUMENTS

| | | | |
|---|---|---|---|
| DE | 44 29 175 | A1 | 3/1995 |
| DE | 196 39 133 | A1 | 2/1998 |
| DE | 60 2006 000 920 | T2 | 8/2008 |
| DE | 10 2017 130969 | A1 | 6/2019 |
| JP | H05 172497 | A | 7/1993 |
| JP | H05 220380 | A | 8/1993 |

OTHER PUBLICATIONS

German Patent Office, Office Action, Application No. 10 2019 123 755.6, dated Jun. 5, 2020, 7 pages (*in German*).

* cited by examiner

PYROTECHNIC IGNITION PILL AND METHOD FOR MANUFACTURING A PYROTECHNIC IGNITION PILL

CROSS-REFERENCE TO RELATED APPLICATIONS

This application is the national phase entry of international patent application no. PCT/EP2020/067312 filed Jun. 22, 2020 and claims the benefit of German patent application No. 10 2019 123 755.6, filed Sep. 5, 2019, the disclosures of which are incorporated herein by reference in their entirety.

TECHNICAL FIELD

The subject matter relates to a pyrotechnic ignition pill and a method for manufacturing a pyrotechnic ignition pill.

BACKGROUND ART

Pyrotechnic ignition pill are well known and widely used in industry. In particular in automotive applications, which are safety-critical, a triggering of a belt tensioner, an airbag, an electrical circuit breaker etc. is often driven pyrotechnically. An ignition pill can be used as a gas generator or as a propellant charge. Particularly for the disconnection of current-carrying electrical conductors, a sufficiently high disconnection energy is required to ensure safe disconnection of the conductors in the event of a crash. Due to the widespread use of pyrotechnic ignition pills, a manufacturing process has become established in which the ignition charge is hermetically sealed in a housing and ignition takes place via two wire contacts that are guided to the outside through a glass bushing. In this case, the ignition contacts are wire-shaped and round.

This is problematic for the use of pyrotechnic ignition pills in more recent applications, such as pyromechanical disconnecting switches for the electrical systems of automobiles. For the cabling of automotive, connector geometries are known and used that are designed for angular connection pins. These are therefore incompatible with conventional pyrotechnic ignition pills.

The subject matter was thus based on the object of making a pyrotechnic ignition pill available for electronic connector housings.

SUMMARY OF THE INVENTION

The structure of a pyrotechnic ignition pill is sufficiently known. A glass pill is enclosed in a sleeve/a ring. The terminal contacts are passed through the glass pill. In a melting process, the glass pill is melted so that the glass forms a gas-tight seal with the terminal contacts. A cover is welded to the sleeve/the ring and inside the cover, connected to the terminal contacts, is an ignition charge. The glass bushing together with the cover and sleeve/ring form the ignition pill housing, which hermetically encloses the ignition charge. A hermetic protection is in particular liquid- and/or gas-tight.

The terminal contacts are electrically connected to the ignition charge within the housing, so that the ignition charge can be triggered by an electrical ignition pulse and explodes. The gas-tight and/or moisture-tight glass feedthrough ensures that the ignition charge does not come into contact with moisture, even over a very long service life, and thus always remains ready for use.

In order to be able to use the ignition pill with conventional connectors for automotive applications, it is proposed that the terminal contacts in the region of the ignition charge have a round cross-sectional profile and that the terminal contacts outside the housing have an angular cross-sectional profile. Angular in the following sense can be understood in particular in such a way that at least two side edges in the cross-sectional profile run parallel to one another. Here, a certain ovality may be present in the transition to the adjacent side edges.

According to an embodiment, it is proposed that the terminal contacts are formed from round wires and are plastically deformed outside the housing. By the plastic deformation, for example by pressing, the round cross-sectional profile can be deformed along at least two side edges so that it becomes angular.

According to an embodiment, it is proposed that the terminal contacts have a first contact spacing from one another in the region of the glass bushing and have a second contact spacing from one another outside the housing, which is greater than the first. The terminal contacts can thus be spread and have a greater distance from one another. Thereby, the contacts can be inserted into openings provided in connection plugs.

According to an embodiment, it is proposed that the terminal contacts run straight and parallel to each other in the glass bushing and outside the glass bushing run at an angle to each other in a central section and again straight and parallel to each other in an end section. Outside the glass bushing and outside the housing, the terminal contacts are deformed in such a way that they point away from each other. In their end sections, however, they may again be deformed so that they are straight and parallel to each other.

According to an embodiment, it is proposed that the terminal contacts are guided through two glass bushings facing each other. On the housing, a glass bushing can be arranged at the cover and at the base respectively. The terminal contacts may be guided through one of the two glass bushings respectively.

According to an embodiment, it is proposed that the terminal contacts are bent away from each other outside the glass bushing. When reference is made here to outside the glass bushing, this always refers to the region of the terminal contacts that is located on the side of the glass bushing facing away from the ignition charge.

According to an embodiment, it is proposed that the bend starts at a distance of at least the radius of the terminal contact from the glass bushing. During the manufacturing, the terminal contacts are arranged as wires running parallel to each other within the glass bushing. No mechanical stress on the glass bushing must be caused by the bending, otherwise it may shatter. To prevent or minimize an effect of the bending on the glass bushing, the bending of the terminal contacts only starts at a distance from the glass bushing. This distance is preferably at least corresponding to the radius of the terminal contact. In this way, bending moments and/or bending stresses can be sufficiently absorbed and deformation of the terminal contact within the glass bushing can be avoided.

According to an embodiment, it is proposed that the glass bushing comprises a glass pill and a support ring. In the manufacturing process, the glass pill is melted and the melted glass nestles against the terminal contacts. A cover of the housing is arranged at the support ring in a material bond, in particular welded to it. The ignition charge is arranged inside the cover. The terminal contacts are short-circuited to one another via an ignition wire which runs inside the ignition charge. An electrical ignition pulse is conducted via the ignition wire, which heats up as a result of the ignition pulse and thereby ignites the ignition charge.

According to an embodiment, it is proposed that on the side of the glass bushing opposite of the ignition charge, the terminal contacts are guided in a connector housing. The ignition pill may comprise a housing which comprises the ignition charge. Furthermore, another housing may be provided in which the terminal contacts are guided and which is shaped as a connector face. The connector face fits to a mated connector contact and can be inserted into it. Inside the connector housing, the connector contacts can be guided and bent.

According to an embodiment, the connector housing is made of a plastic, in particular injection molded. The connector housing is molded onto the support ring.

According to an embodiment, it is proposed that the angular cross-sectional profile is formed by two longitudinal edges running parallel to one another and two transverse edges lying opposite one another, wherein the transverse edges are formed in an arcuate shape, in particular in a convex-arcuate shape. In cross-section through the terminal contacts, these can be approximately oval with two side edges running parallel to each other. This may be understood to be angular.

Another aspect is a method of manufacturing a pyrotechnic ignition pill. Here, a housing with an enclosed ignition pill with at least two terminal contacts extending out of the housing through a glass bushing is first provided. Subsequently, the ignition pill is mechanically fixed and the terminal contacts are mechanically deformed outside the housing, on the side of the glass bushing opposite of the ignition charge, such that the terminal contacts outside the housing have an angular cross-sectional profile.

According to an embodiment, the angular cross-sectional profile is obtained by pressing.

Furthermore, the terminal contacts can be bent apart outside the housing. In this case, it is possible, for example, to fix the terminal contacts and to bend them apart at their free ends. The fixation preferably lies directly against the glass bushing and thus prevents forces introduced by the bending from reaching up to the glass bushing.

BRIEF DESCRIPTION OF THE DRAWINGS

In the following, the subject matter is explained in more detail with reference to drawings showing exemplary embodiments. The drawings show.

DETAILED DESCRIPTION OF SPECIFIC EMBODIMENTS

Figure 1A:
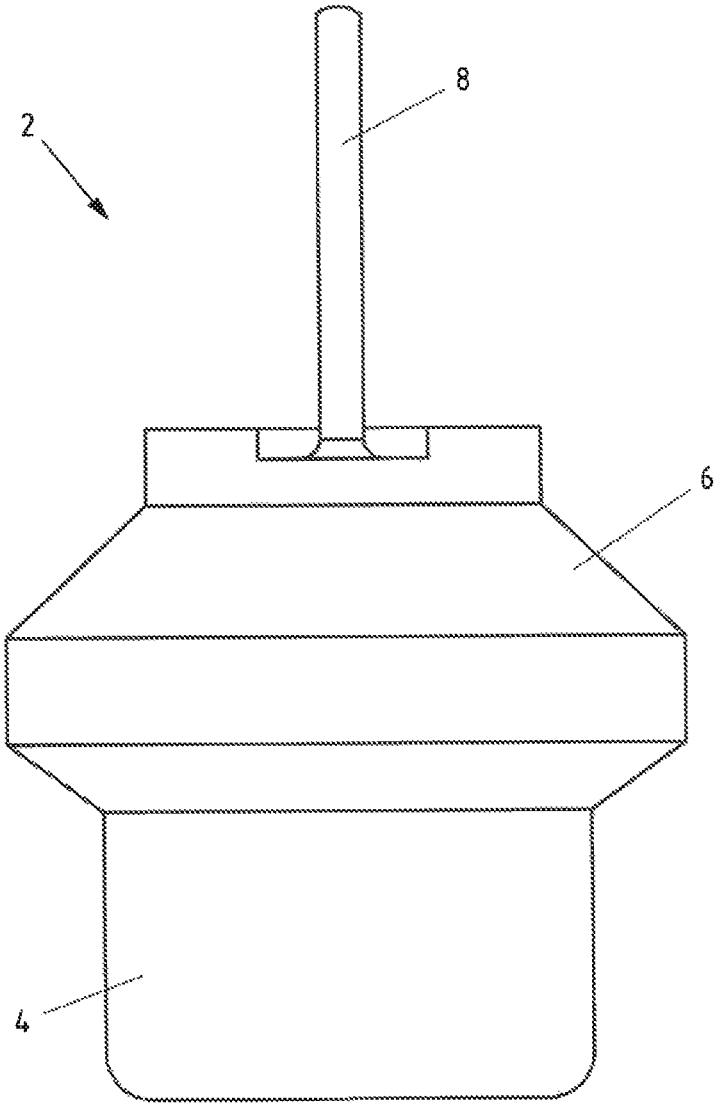
FIG. 1*a, b* a longitudinal section through a pyrotechnic ignition pill according to a first embodiment.

FIG. 1*a* shows a pyrotechnic ignition pill 2 in a side view. The pyrotechnic ignition pill 2 has a housing 4 and a connector housing 6. Terminal contacts 8 are led out of the housing 4 and the connector housing 6. A pyrotechnic ignition charge is enclosed in the housing 4. The connector housing 6 accommodates the terminal contacts 8 led out of the housing 4 and guides them to the outside, as shown in more detail in FIG. 1*b*.

Figure 1B:
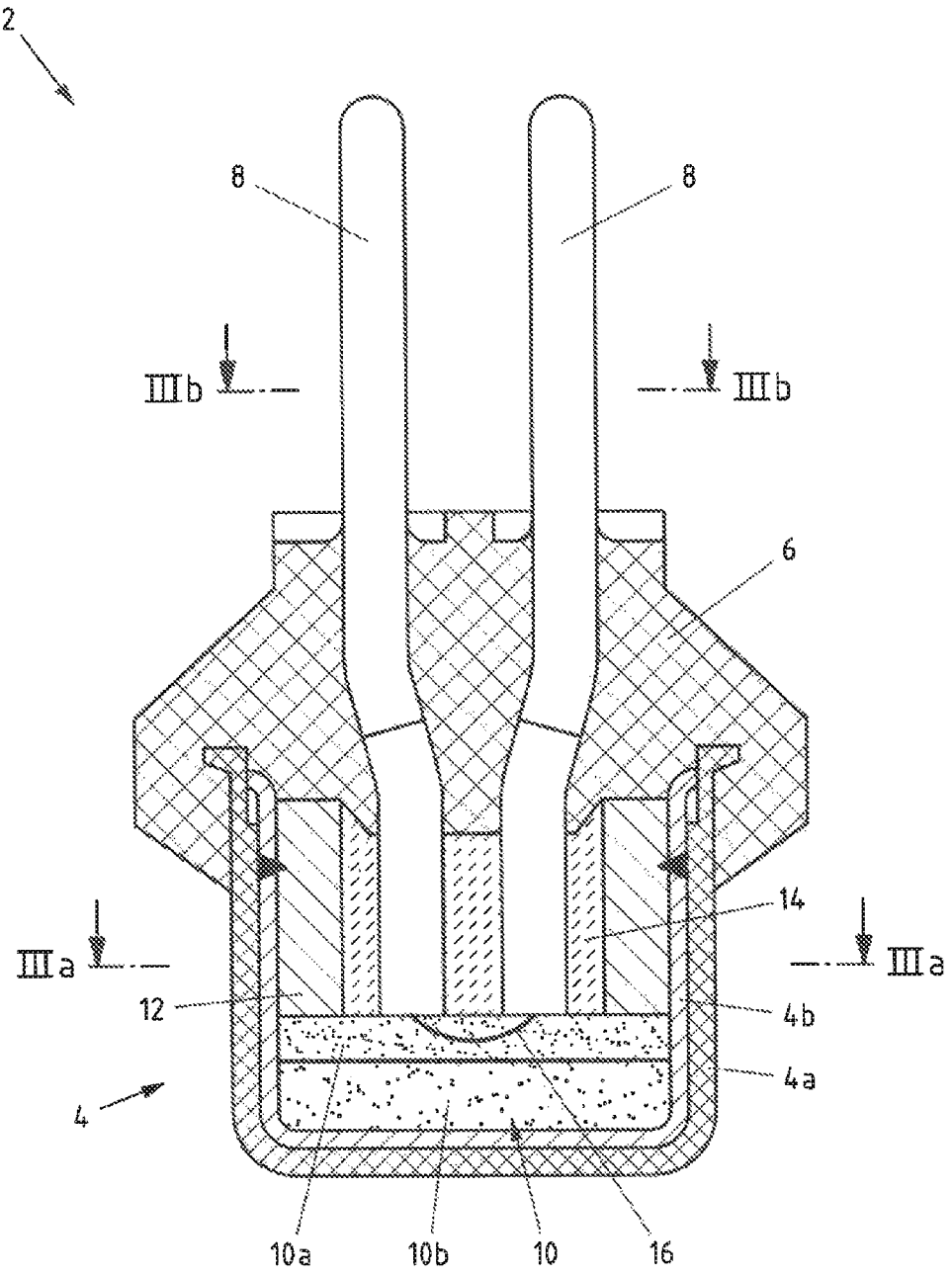

In FIG. 1*b*, the housing 4 is shown in a sectional view. The housing 4 comprises a two-layer cover formed by an outer insulation layer 4*a* and an inner metal layer 4*b*. Inside the lid 4*a*, 4*b* there is an ignition charge 10, which may also be formed of an ignition charge 10*a* and a propellant charge 10*b*. The metallic layer 4*b* of the lid 4*a*, 4*b* is circumferentially welded to a ring 12. The ring 12 receives a glass bushing 14. In the glass bushing 14, two terminal contacts 8 are guided so as to run parallel to one another.

To manufacture the housing 4 including the the ignition charge 10, a ring 12 is first fitted with a glass pill. The terminal contacts 8 are pushed through the glass pill.

The glass of the glass pill is melted and nestles against the terminal contacts 8 inside the ring 12, forming a gas-tight connection. On the inside of the housing 4, the terminal contacts 8 are electrically short-circuited to each other via an ignition wire. The ignition wire runs through the ignition charge 10, in particular the ignition charge 10*a*.

The cover 4*a*, 4*b* is placed on the ignition charge 10, in particular initially with the metal layer 4*b*. The metal layer 4*b* is circumferentially welded, for example laser welded, to the ring 12. Subsequently, the insulation layer 4*a* is positioned and the connector housing 6 is overmolded around the "naked" igniter. The igniter is now ready for use. By the cover 4*b* and the glass bushing 14, the igniter charge 10 is hermetically shielded and is thus enclosed gas-tight and/or moisture-tight from the environment.

For further use, a connector housing 6 is molded onto the housing 4, for example by means of injection molding.

It can be seen in FIG. 1*b* that the terminal contacts 8 run parallel to one another within the glass bushing 14. On the side of the glass bushing 14 opposite the ignition charge 10, the terminal contacts 8 are bent apart, but again run parallel to each other outside the connector housing 6.

Figure 2A:
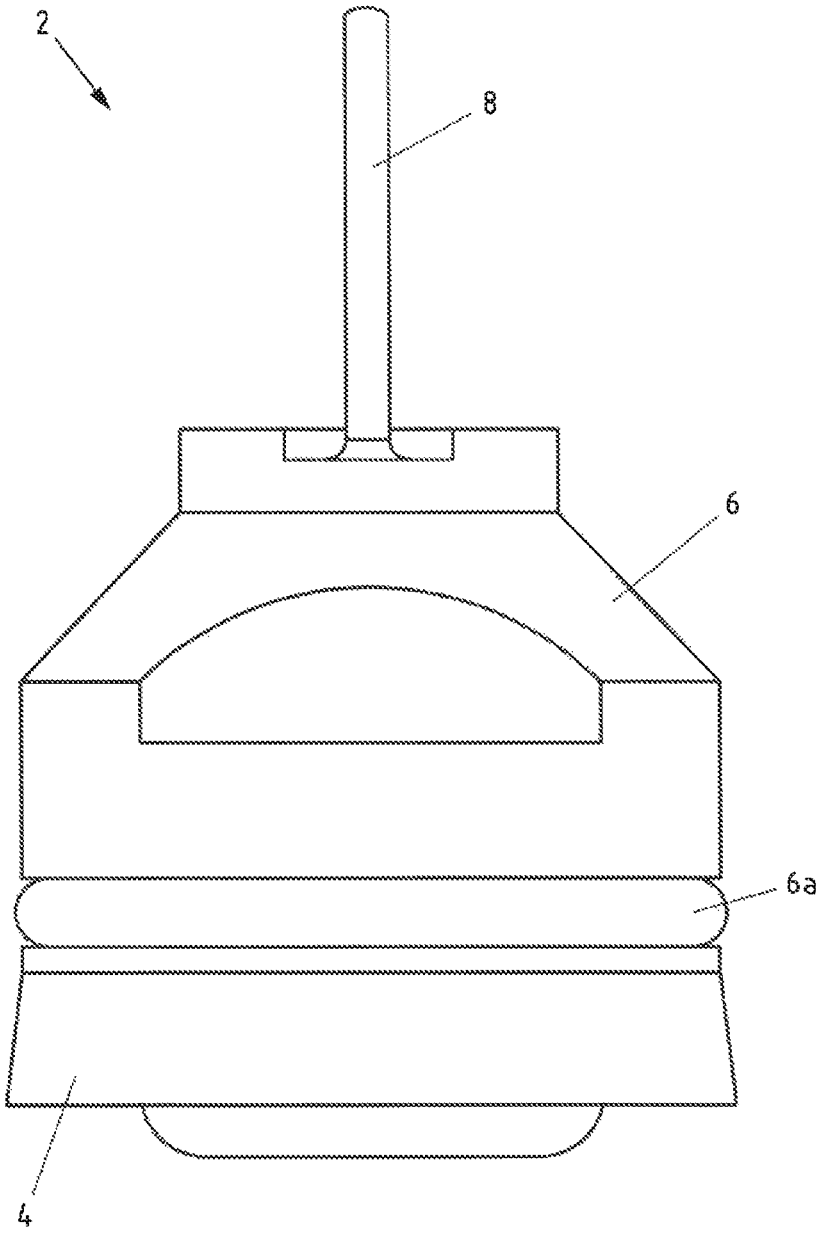
FIG. 2*a, b* a pyrotechnic ignition pill according to a further embodiment.
Figure 2B:
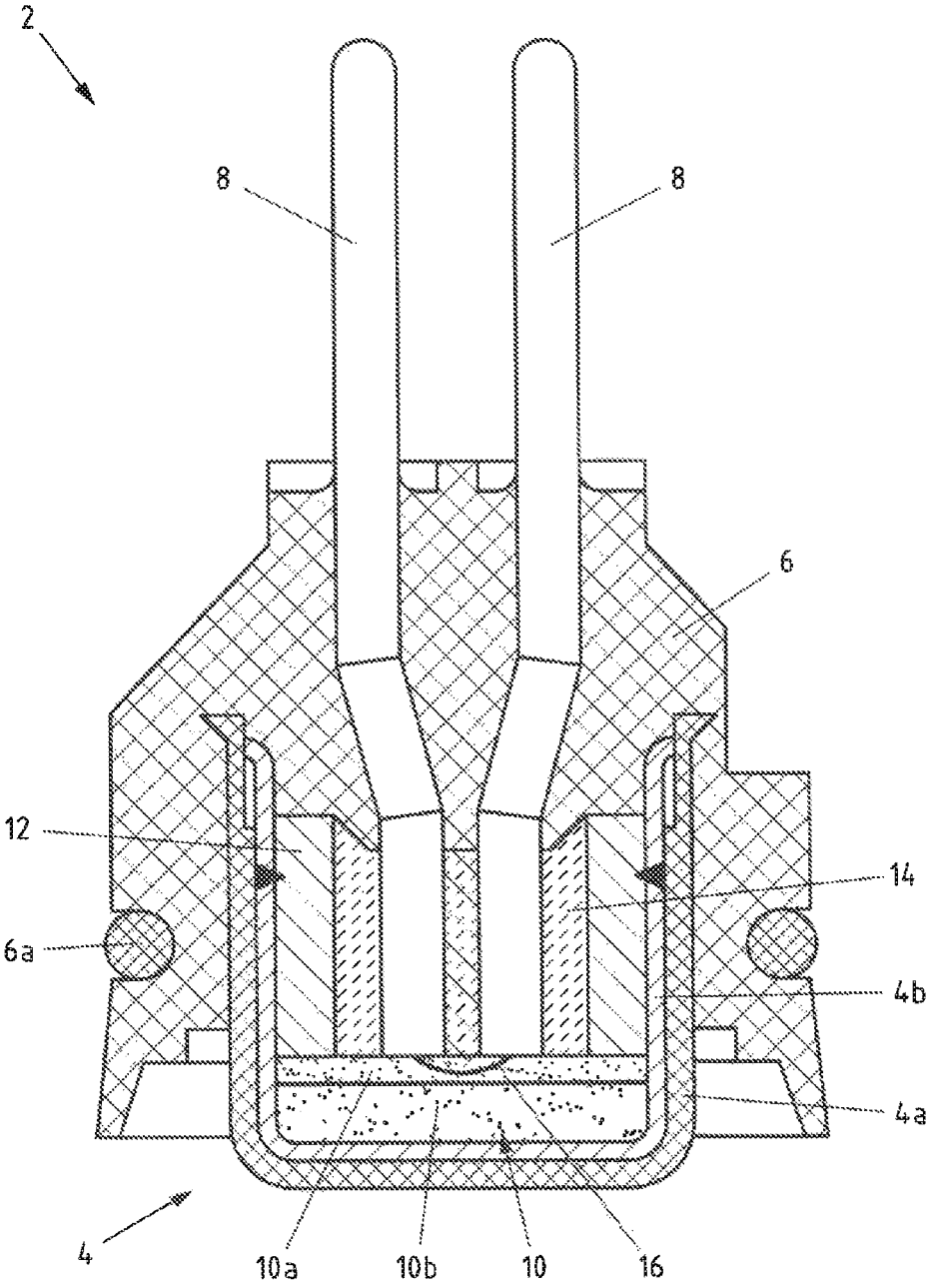

FIGS. 2*a, b* show essentially the same elements, although the connector housing 6 as shown in FIG. 2*b* is provided with an O-ring 6*a* to enable it to be inserted into a socket in a moisture-tight manner if necessary.

In contrast to FIG. 2*a*, in FIG. 2*b* the bending of the terminal contacts 8 is discontinuous, so that the terminal contacts 8 are diverging in a V-shaped, angular manner.

The ignition pill 2 is fixed to the terminal contact 8 before or after the connector housing 6 has been injection moulded. In this process, the terminal contacts 8 can be fixed directly above the glass bushing 14 by grippers. Subsequently, pressing tools can press the end regions of the terminal contacts 8 that are outside the connector housing 6 in the finished product so that cross-sectional profiles are formed as shown in FIGS. 3*a, b*.

Figure 3B:
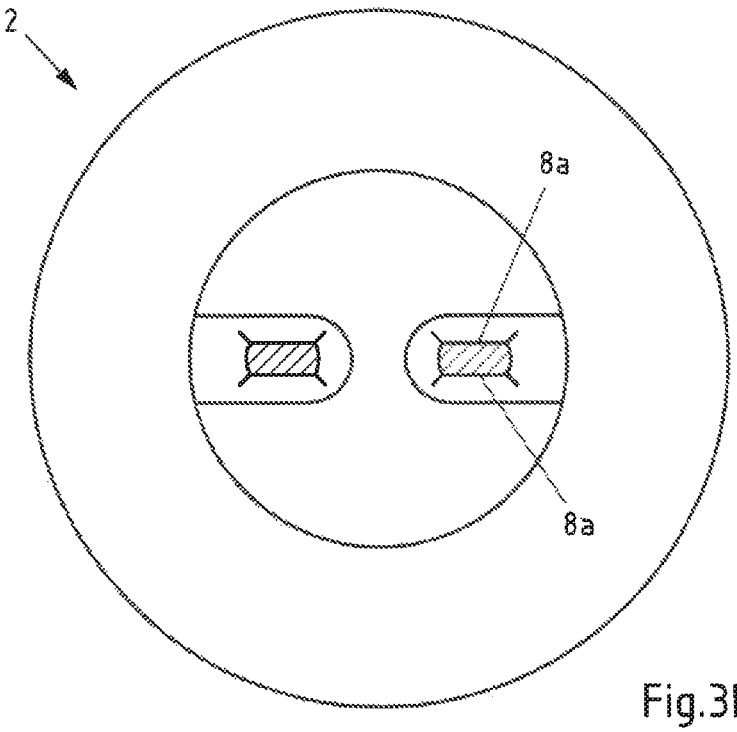
FIG. 3*a, b* cross-sections through terminal contacts.
Figure 3A:
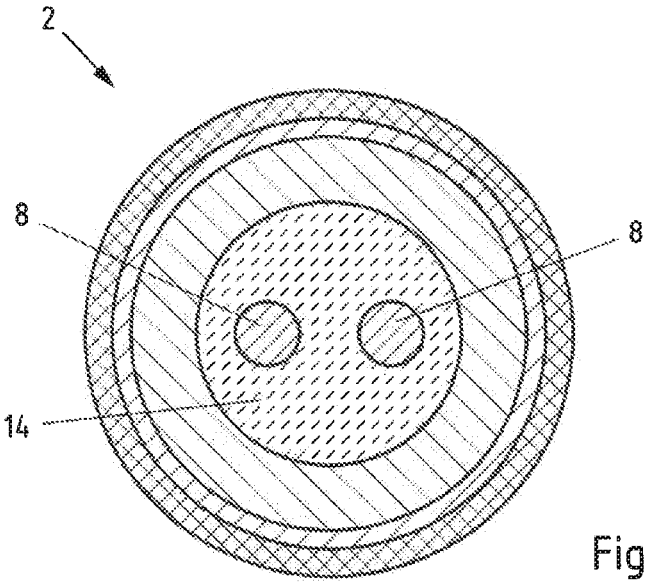

FIG. 3*a* shows the cross-sectional profile of the terminal contacts 8 inside the glass bushing 14. It can be seen that the terminal contacts 8 are round. This in particular results from the use of connecting wires for the terminal contacts 8.

By pressing, the terminal contacts 8 are brought into an angular cross-sectional profile outside the connector housing as shown in FIG. 3*b*. It can be seen that two opposing side edges 8*a* run parallel to each other, respectively. The short edges can also run parallel to each other, but can also be convex. In FIG. 3*b*, it can be seen that the terminal contacts 8 have a certain ovality in their cross-sectional profile, which is also to be understood by angular according to the subject matter.

Figure 4:
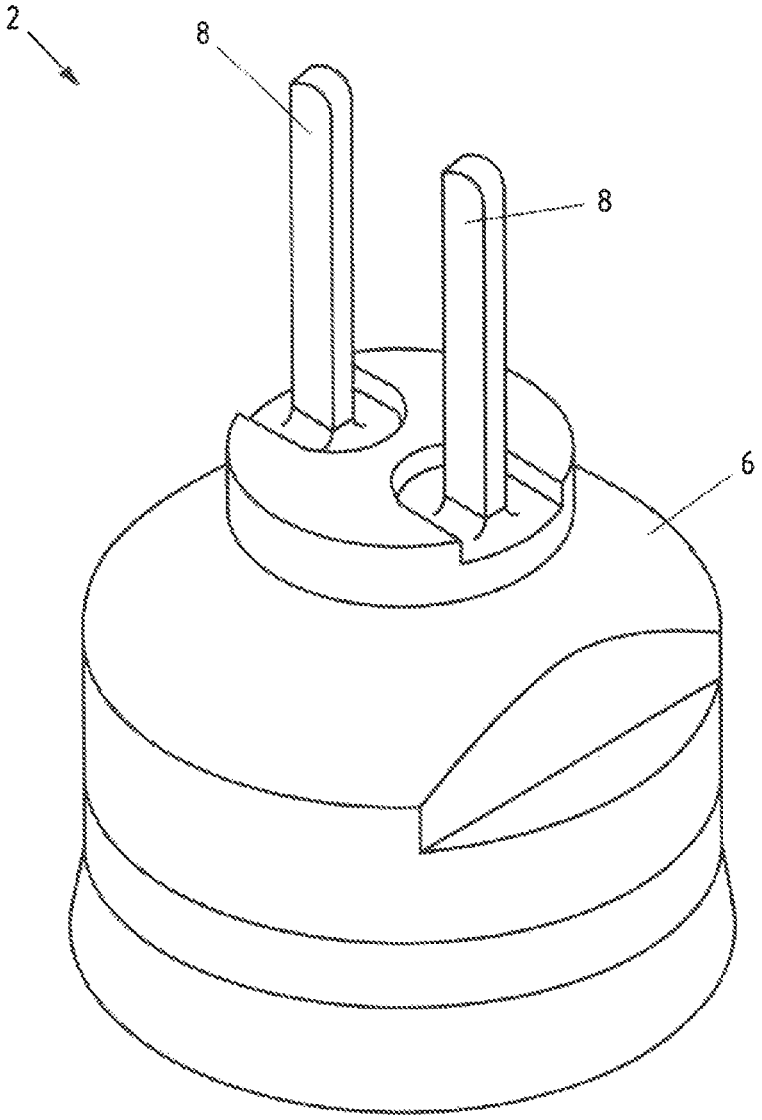
FIG. 4 a view of a pyrotechnic ignition pill.

FIG. 4 shows the ignition pill 2 in a view. It can be seen that the terminal contacts 8 are formed as flat parts outside the connector housing 6. This is done by pressing the terminal contacts 8 with the aid of pressing tools.

Figure 5:
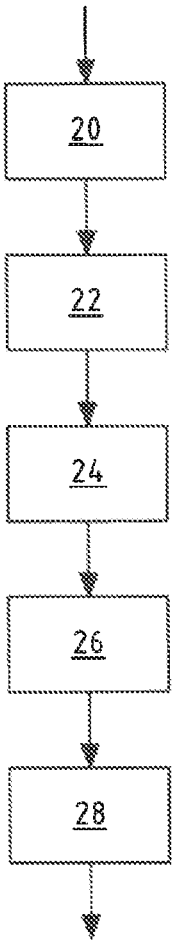
FIG. 5 a sequence of a method according to the subject matter.

FIG. 5 shows the sequence of a method according to the subject matter. First, a ignition pill 2 is made available (20). Subsequently (22), the priming pill 2 is fixed with gripper arms, for example by fixing the terminal contacts 8 directly at the exit out of the glass bushing 14. After the terminal contacts have been fixed, an end region of the respective terminal contacts 8 is pressed (24) with a pressing tool. The pressing tool can have lateral limiting sliders so that the terminal contacts 8 have a defined width after pressing.

After step 24 or before step 24, a bending of the terminal contacts 8 outwards can be carried out in a step 26, as shown in FIGS. 1*b* and 2*b*.

Subsequently, an injection molding of a connector housing 6 can be performed in step 28.

LIST OF REFERENCE SIGNS

2 Firing pellet
4 Housing
6 Connector housing
8 Terminal contacts
10 Ignition charge
12 Ring
14 Glass bushing
16 Ignition wire
20 Provision
22 Fixing
24 Pressing
26 Spreading
28 Overmolding

What is claimed is:

1. Pyrotechnic ignition pill with
a housing,
an ignition charge housed in the housing,
at least two terminal contacts connected to the ignition charge,
wherein the terminal contacts are guided out of the housing through at least one glass bushing, wherein
the terminal contacts in the region of the ignition charge have a round cross-sectional profile and the terminal contacts outside the housing have an angular cross-sectional profile such that the terminal contacts with angular cross-sectional profile are adapted for connector geometries which are designed for angular connection pins.

2. Pyrotechnic ignition pill according to claim 1, wherein the terminal contacts are formed from round wires and are plastically deformed outside the housing.

3. Pyrotechnic ignition pill according to claim 1, wherein the terminal contacts have a first contact spacing in the region of the glass bushing and have a second contact spacing outside the housing which is greater than the first contact spacing.

4. Pyrotechnic ignition pill according to claim 1, wherein the terminal contacts in the glass bushing run straight and parallel to one another and run at an angle to one another outside the glass bushing in a central section and run parallel to one another in an end section.

5. Pyrotechnic ignition pill according to claim 1, wherein the terminal contacts are guided through two glass bushings facing each other.

6. Pyrotechnic ignition pill according to claim 1, wherein the terminal contacts outside the glass bushing are bent facing away from one another.

7. Pyrotechnic ignition pill according to claim 6, wherein the bend begins at a distance of at least the radius of the terminal contact from the glass bushing.

8. Pyrotechnic ignition pill according to claim 1, wherein the glass bushing has a glass pill and a support ring, a cover of the housing is arranged on the support ring in a material bond, and the ignition charge is arranged in the interior of the cover.

9. Pyrotechnic ignition pill according to claim 1, wherein the terminal contacts are guided in a connector housing on the side of the glass bushing opposite the ignition charge.

10. Pyrotechnic ignition pill according to claim 9, wherein the connector housing is made of a plastic, in particular injection-moulded, and/or the terminal contacts are bent inside the connector housing.

11. Pyrotechnic ignition pill according to claim 9, wherein the connector housing is formed onto the support ring and the glass bushing.

12. Pyrotechnic ignition pill according to claim 1, wherein the angular cross-sectional profile is formed by two longitudinal edges running parallel to one another and two transverse edges opposing one another, wherein the transverse edges are formed in an arcuate shape, in particular in a convex arcuate shape.

* * * * *